US011784442B2

(12) United States Patent
Kliever

(10) Patent No.: US 11,784,442 B2
(45) Date of Patent: Oct. 10, 2023

(54) ELECTRICAL CONNECTOR HAVING FUSE HOLDER

(71) Applicant: HARTING ELECTRIC STIFTUNG & CO. KG, Espelkamp (DE)

(72) Inventor: Wilhelm Kliever, Espelkamp (DE)

(73) Assignee: HARTING ELECTRIC STIFTUNG & CO. KG

( * ) Notice: Subject to any disclaimer, the term of this patent is extended or adjusted under 35 U.S.C. 154(b) by 0 days.

(21) Appl. No.: 17/762,015

(22) PCT Filed: Oct. 12, 2020

(86) PCT No.: PCT/DE2020/100881

§ 371 (c)(1),
(2) Date: Mar. 18, 2022

(87) PCT Pub. No.: WO2021/078327

PCT Pub. Date: Apr. 29, 2021

(65) Prior Publication Data

US 2022/0329018 A1 Oct. 13, 2022

(30) Foreign Application Priority Data

Oct. 21, 2019 (DE) ..... 10 2019 128 379.5

(51) Int. Cl.
*H01R 13/68* (2011.01)
*H01R 13/688* (2011.01)
*H01R 13/717* (2006.01)

(52) U.S. Cl.
CPC ..... *H01R 13/688* (2013.01); *H01R 13/7175* (2013.01)

(58) Field of Classification Search
CPC ..... H01R 13/688; H01R 13/7175; H01R 13/6691; H01R 13/502
See application file for complete search history.

(56) References Cited

U.S. PATENT DOCUMENTS 1,743,821 A 1/1930 Kollath
2,676,223 A 4/1954 Whitaker ..... 200/115.5
(Continued)

FOREIGN PATENT DOCUMENTS

CN 2488197 4/2002 ..... H01R 13/68
CN 207896359 9/2018 ..... H01R 13/688
(Continued)

OTHER PUBLICATIONS

International Preliminary Report on Patentability issued in PCT/DE2020/100881, dated Apr. 26, 2022, 5 pages.
(Continued)

*Primary Examiner* — Truc T Nguyen
(74) *Attorney, Agent, or Firm* — HAYES SOLOWAY P.C.

(57) ABSTRACT

The industrial electrical connector is composed of an upper housing portion for holding a conductor and a lower housing portion for holding at least one contact carrier, which lower housing portion can be releasably connected to the upper housing portion. The contact carrier holds at least one contact. The contact is intended to establish a connection to a corresponding mating contact for the transfer of at least electrical energy and/or electrical signals/data. At least one fuse holder for holding at least one electrical fuse is arranged within the industrial electrical connector.

19 Claims, 4 Drawing Sheets

(56) References Cited

U.S. PATENT DOCUMENTS

Figure 1:
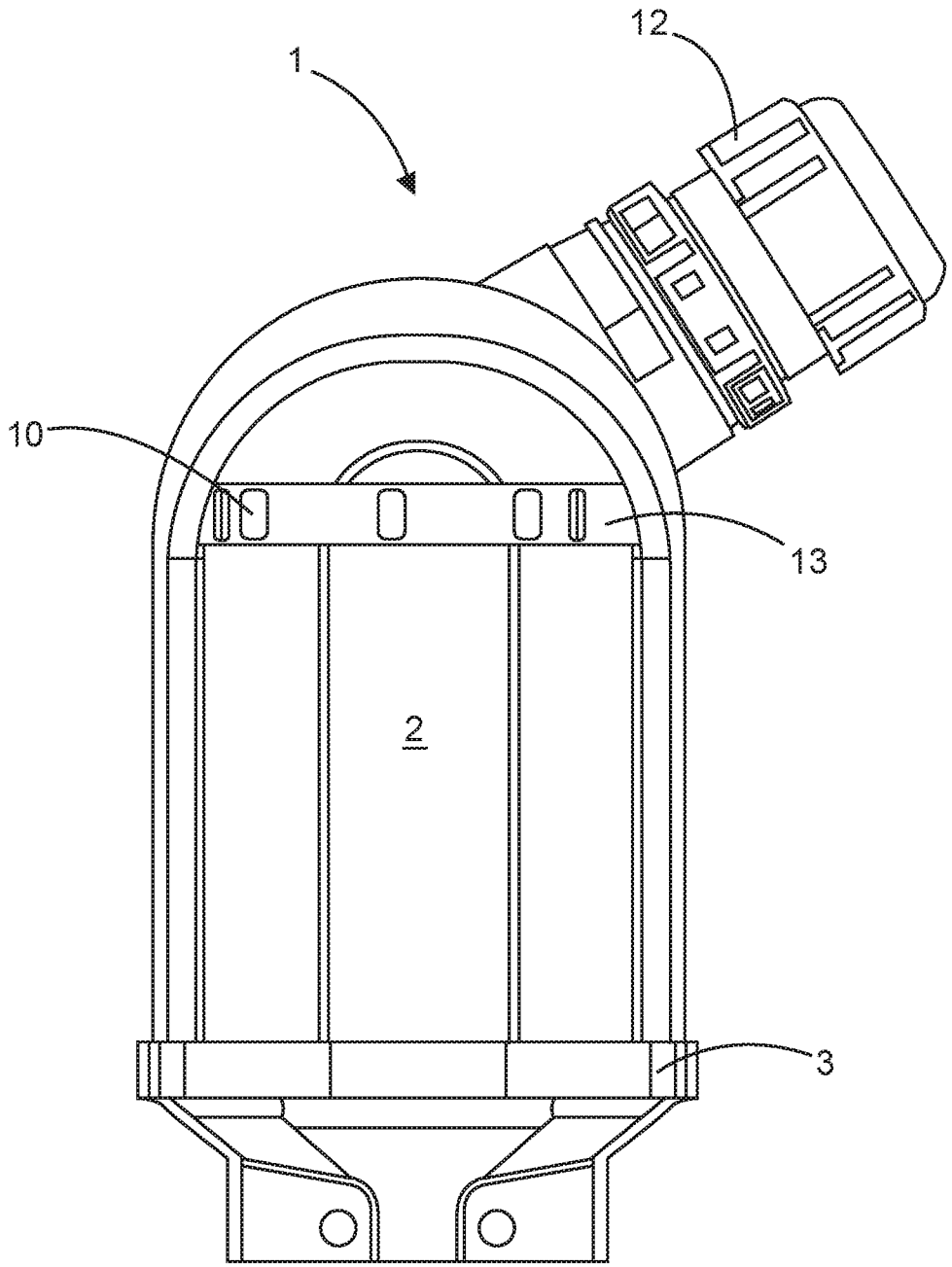

| | | | | |
|---|---|---|---|---|
| 3,116,386 | A | 11/1960 | Sperzel | 200/115.5 |
| 4,959,025 | A * | 9/1990 | Eberhard | H01H 13/68 337/230 |
| 6,746,279 | B1 | 6/2004 | Lopez | 439/620 |
| 10,218,130 | B1 * | 2/2019 | Jung | H01R 13/506 |
| 10,477,717 | B2 * | 11/2019 | Hasija | H05K 5/069 |
| 10,978,835 | B2 * | 4/2021 | Huang | H01R 13/7137 |
| 2003/0003808 | A1 | 1/2003 | Liu | 439/622 |
| 2004/0053534 | A1 | 3/2004 | Beneke et al. | 439/610 |
| 2005/0014412 | A1 | 1/2005 | Wharton | 439/352 |
| 2007/0008061 | A1 | 1/2007 | Chen | 337/187 |
| 2012/0315790 | A1 | 12/2012 | Hein et al. | 439/574 |
| 2014/0148045 | A1 * | 5/2014 | Kashiwada | H01R 13/688 439/485 |
| 2016/0104974 | A1 * | 4/2016 | Yamaguchi | H01H 85/202 439/607.01 |
| 2019/0237913 | A1 | 8/2019 | Nass et al. | H01R 13/6666 |

FOREIGN PATENT DOCUMENTS

| | | | |
|---|---|---|---|
| CN | 110718818 | 1/2020 | H01R 13/684 |
| DE | 202 14 132 | 1/2003 | H01R 13/658 |
| DE | 10 2010 002 176 | 8/2011 | H01R 13/58 |
| DE | 20 2017 100 408 | 3/2017 | H01R 13/68 |
| DE | 10 2016 116 926 | 3/2018 | H01R 13/66 |
| GB | 2 355 601 | 4/2001 | H01R 13/68 |
| JP | H09-50868 | 2/1997 | H01R 13/68 |

OTHER PUBLICATIONS

International Search Report and Written Opinion issued in PCT/DE2020/100881, dated Jan. 12, 2021, with English translation, 14 pages.

German Search Report issued in German Patent Appln. 10 2019 128 379.5, dated Aug. 5, 2020, with machine English translation, 11 pages.

* cited by examiner

ELECTRICAL CONNECTOR HAVING FUSE HOLDER

The invention proceeds from an industrial electrical connector having an electrical fuse holder.

In this context, an electrical fuse holder is understood to mean a holding device for electrical fuses. The electrical fuses may be, in particular, overcurrent protection devices such as safety fuses.

Such electrical connectors are needed to transmit energy, especially electrical energy, signals and/or data to devices such as work machines, switch cabinets or similar devices, especially in industrial environments.

PRIOR ART

The prior art shows industrial electrical connectors in various designs. These electrical connectors are usually characterised by a particularly robust design and are also referred to as "heavy-duty electrical connectors".

Furthermore, in the prior art there are appliance connector plugs, for example known from the domestic field, which are provided with electrical fuses integrated in the appliance connector plug to protect against overload. For example, U.S. Pat. No. 2,676,223 A from 1954 already discloses a domestic electrical connector with a body made of insulating material and plug contacts located therein, wherein a cavity in front of a plug contact is designed to receive an electrical fuse therein, and wherein this cavity is closed by a corresponding plug contact and a bayonet closure arranged thereon in the body made of insulating material.

However, the prior art does not provide an industrial electrical connector with a device for accommodating fuses. This is because, for the most part, industrial electrical connectors are used in environments in which a switch cabinet is used, wherein the switch cabinet is already equipped with corresponding overcurrent protection devices and/or overvoltage protection devices.

However, if a corresponding device fails, a specialist is often required to locate the corresponding source of the fault in a switch cabinet, for example. Particularly in the industrial environment, fault localization can take a lot of time due to switch cabinets that are necessarily becoming more and more complex. In addition, planned higher loads may occur in some systems. For example, systems in the information technology sector could be deliberately overloaded for a short period of time in order to absorb or enable power peaks. It may therefore be expedient to have an affected energy line replaced first by less qualified personnel or bypassed to save time. Subsequently, the replaced, defective energy line can be checked centrally by a specialist, for example, in order to exclude the energy line as a source of error or to eliminate a defect that has occurred.

The German Patent and Trade Mark Office has searched the following prior art in the priority application for the present application: DE 10 2010 002 176 A1; DE 10 2016 116 926 A1; DE 202 14 132 U1, DE 20 2017 100 408 U1, GB 2 355 601 A; U.S. Pat. No. 6,746,279 B1, US 2005/0014412 A1; US 2007/0008061 A1; U.S. Pat. Nos. 1,743,821 A; 3,116,386 A; CN 2 488 197 Y, CN 110 718 818 A; CN 207 896 359 U and JP H09-50868 A.

Problem to be Solved

The problem addressed by the invention is that of providing an industrial electrical connector which makes the maintenance of a system, in particular an industrial system, easier and more straightforward and thus in particular reduces the potential danger for less experienced maintenance personnel.

Advantageous embodiments of the invention are given in the following description.

Disclosure of the Invention

The industrial electrical connector according to the invention is composed of an upper housing portion for holding a conductor and a lower housing portion for holding at least one contact carrier, which lower housing portion can be releasably connected to the upper housing portion. The contact carrier holds at least one contact. The contact is intended to establish a connection to a corresponding mating contact for the transfer of at least electrical energy and/or electrical signals/data. At least one fuse holder for holding at least one electrical fuse is arranged within the industrial electrical connector. The upper housing portion in this context means the portion of the industrial electrical connector that is capable of accommodating conductors and lines. The term "conductors" means, in particular, cables for the transfer of electrical energy. Alternatively and/or additionally, other conductors, for example for fluids, can be used. In this context, the term "fuse holder" means a device for accommodating an electrical fuse for electrically conductive connection to at least one electrical conductor. In other words, the fuse holder establishes an electrical connection between the contact inserted in the contact carrier and a conductor introduced in the upper housing portion by means of an inserted fuse. The current and/or the voltage of the electrical conductor attached to the fuse holder is then protected by an inserted fuse. Preferably, what are known as safety fuses are used as fuses, which, in the event of an excessively high current intensity applied over a certain period of time, burn through and thus protect subsequent components from damage. Depending on the system to be connected, it is expedient to use a plurality of fuses instead of one fuse. Advantageously, the fuse holder holds two fuses. Preferably, the fuse holder holds three fuses. Alternatively, multiple fuse holders can be used, wherein the fuse holders hold any number of fuses. Preferably, three fuse holders are used, each of which holds one fuse.

In particular, the industrial electrical connector can have means for fixing the introduced cable, for example a cable gland. On the mating side, the industrial electrical connector is provided, among other things, by a corresponding mating opening and in particular by a corresponding so-called "mating face" for mating with a corresponding mating electrical connector, e.g. for signal and/or power transfer. The industrial electrical connector may also have a separate so-called "holding frame" and/or a comparably acting holding mechanism fixedly integrated in the industrial electrical connector, as well as a plurality of insulating bodies arranged therein in the form of so-called "electrical connector modules". Furthermore, the industrial electrical connector may consist at least partially of metal and may be designed for high current intensities and/or voltages, for example, current intensities greater than 50 amperes, in particular greater than 100 amperes, preferably current intensities greater than 250 amperes, in particular current intensities greater than 500 amperes. Alternatively or additionally, voltages above 60 V, in particular above 220 V, for example above 600 V, thus also voltages above 1000 V can be transferred via such an industrial electrical connector. For protective grounding, the industrial electrical connector can have at least one PE ("Protection Earth") contact, for example in the form of a PE screw or a plug contact.

In an expedient embodiment, the industrial electrical connector has a carrier element which accommodates the fuse holder and wherein the carrier element is connected to one of the two housing portions. Here, in a preferred embodiment, the carrier element is connected to the lower housing portion. Depending on the shape of the housing, it may also be expedient to make the carrier element connectable to the upper housing portion. By using a carrier element, the positioning of the fuse holder within the industrial electrical connector can be reliably determined. As a result, the connecting conductors can be preassembled from the contacts positioned in the contact carrier to form a fuse holder, which considerably simplifies a manufacturing process, or assembly process, as well as maintenance.

In one embodiment, it is recommended that the fuse holder be releasably connected to a carrier element. In this way, excellent accessibility to the contacts inserted in the contact carrier can be ensured during an assembly process of the industrial electrical connector. Furthermore, a connection from the contacts to the fuse holder can be easily established. This is because this embodiment allows a contact connected to a conductor to be inserted into the contact carrier first, the contact carrier can be introduced into the lower housing portion, and then the conductor can be connected to the fuse holder before the latter is releasably connected to the carrier element.

A further embodiment provides for the carrier element to be releasably connected to the upper housing portion or the lower housing portion. This both increases ease of assembly and further simplifies maintenance. Thus, a fuse holder according to the invention may be fixedly connected to a carrier element. Nevertheless, an assembly similar to the preceding description is simplified because contacts can first be inserted into the contact carriers, and then conductors connected to the contacts can be connected to the fuse holder, and then the fuse holder can be attached to a housing portion. In addition, a corresponding industrial electrical connector can be used more diversely in this way, since it can be used as a regular industrial electrical connector. For this purpose, the releasably connectable carrier element is omitted, provided there is no longer a need for electrical fusing of the current-carrying conductors.

One conceivable embodiment recommends connecting the carrier element and the fuse holder to at least one corresponding connecting element each. A form-fit connection between the fuse holder and the carrier element is particularly preferred here. For this purpose, for example, a standardized rail, a so-called "top-hat rail", can be arranged on a carrier element. The use of a top-hat rail makes it possible to use fuse holders that are normally used in switch cabinets. Such a design enables a particularly high number of variants. Such modularity can be particularly advantageous in the case of differing requirements for the various lines to be protected.

In a particularly preferred embodiment, the state of at least one inserted electrical fuse can be read through a viewing opening in the upper housing portion and/or the lower housing portion. In one embodiment, a viewing window is designed to allow visual inspection of the electrical fuse. Cleverly, the state of at least one inserted electrical fuse is reproduced by at least one signal. Preferably, the state of an inserted electrical fuse is indicated here by an illuminant. Particularly preferably, the illuminant is a light-emitting diode (LED). A light-emitting diode can be advantageously arranged on the fuse holder by means of a viewing window. Nevertheless, the state of the electrical fuse held by the fuse holder can be seen from outside the industrial electrical connector. In the event of a defect, the maintenance personnel can recognize at first glance a cable with an industrial electrical connector according to the invention that needs to be replaced.

The industrial electrical connector can also have a locking mechanism, for example, in the form of a locking clip or two push-buttons or the like, for locking the industrial electrical connector to the mating electrical connector plugged into it. The push-buttons may have the advantage of simplified operation, since only the two push-buttons have to be moved towards each other for locking, i.e. they can advantageously be pressed together by the user one-handedly. The locking clip may have the advantage that it automatically presses the industrial electrical connector and the mating electrical connector against each other in a sealing manner during locking, without the need for a special mechanism. In particularly preferred embodiments, locking can also be automated, for example by means of a corresponding electromechanical device. In this way, for example, "pulling under load" can also be prevented.

EXEMPLARY EMBODIMENT

Figure 2:
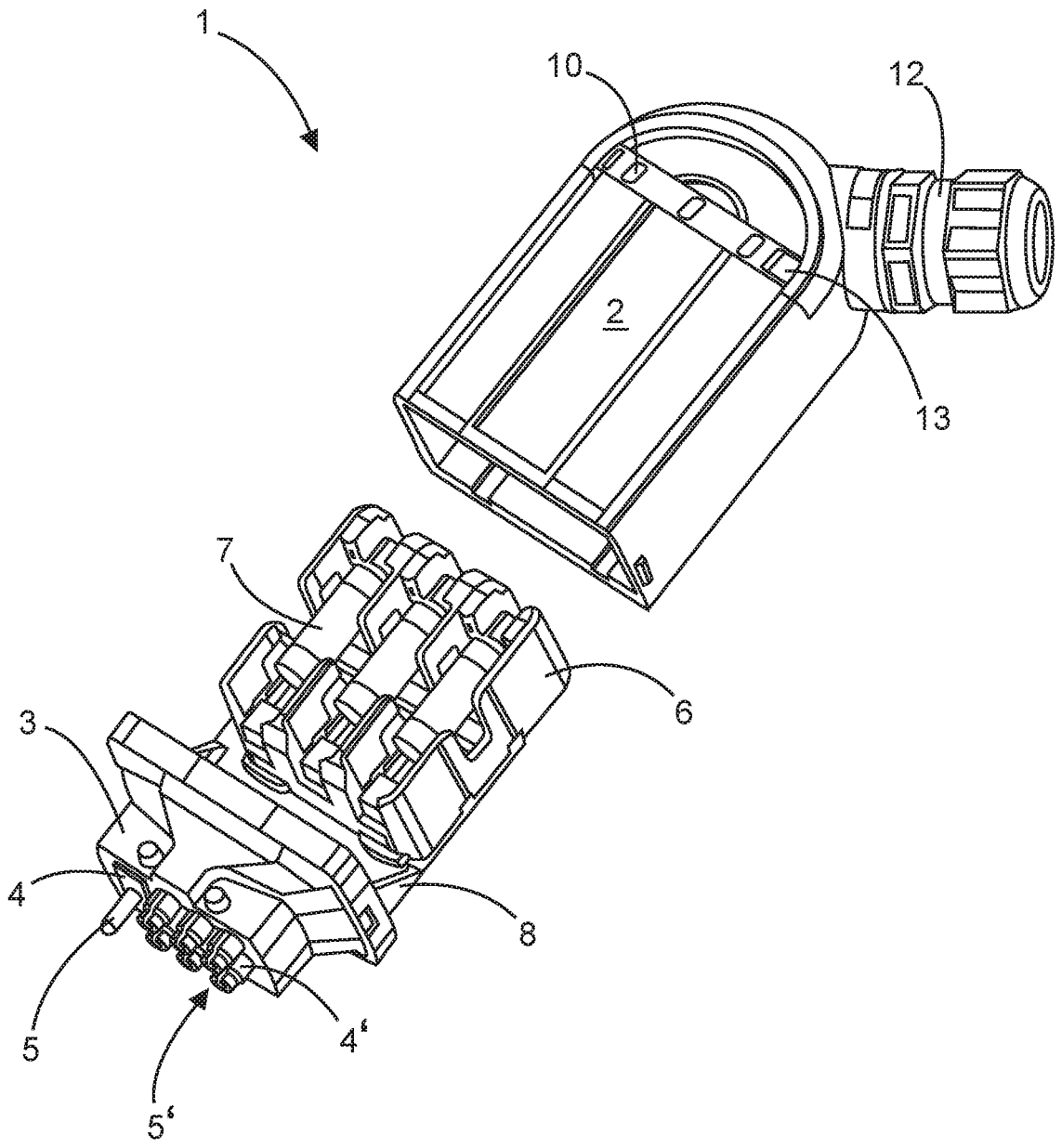
Figure 3:
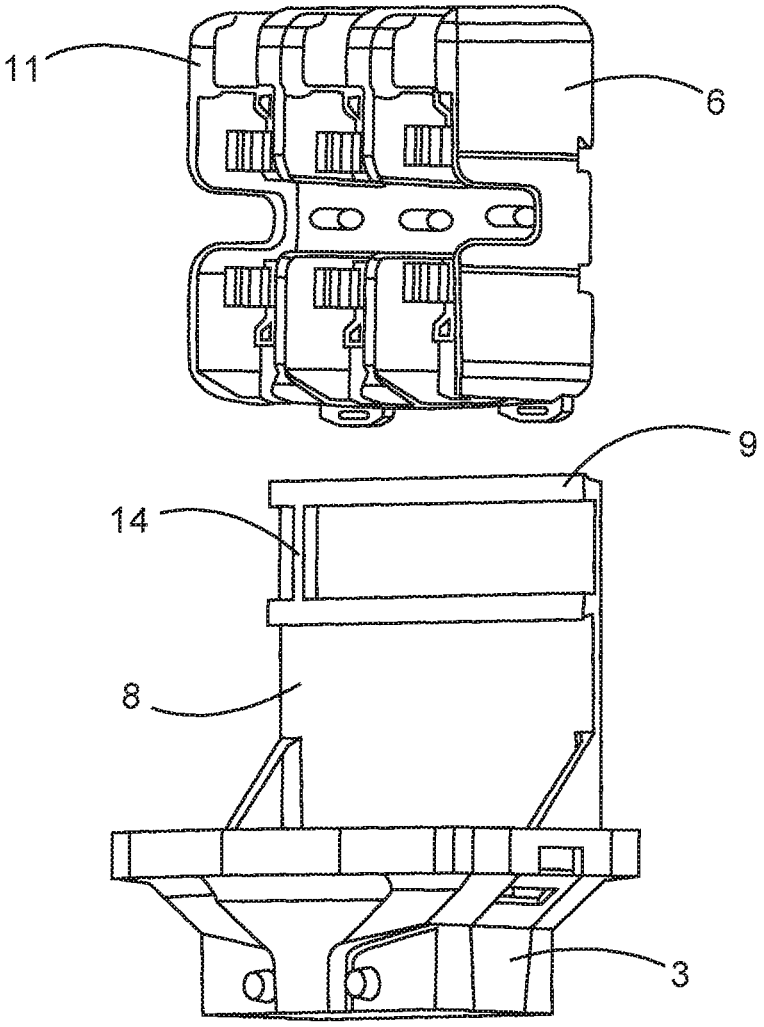
Figure 4:
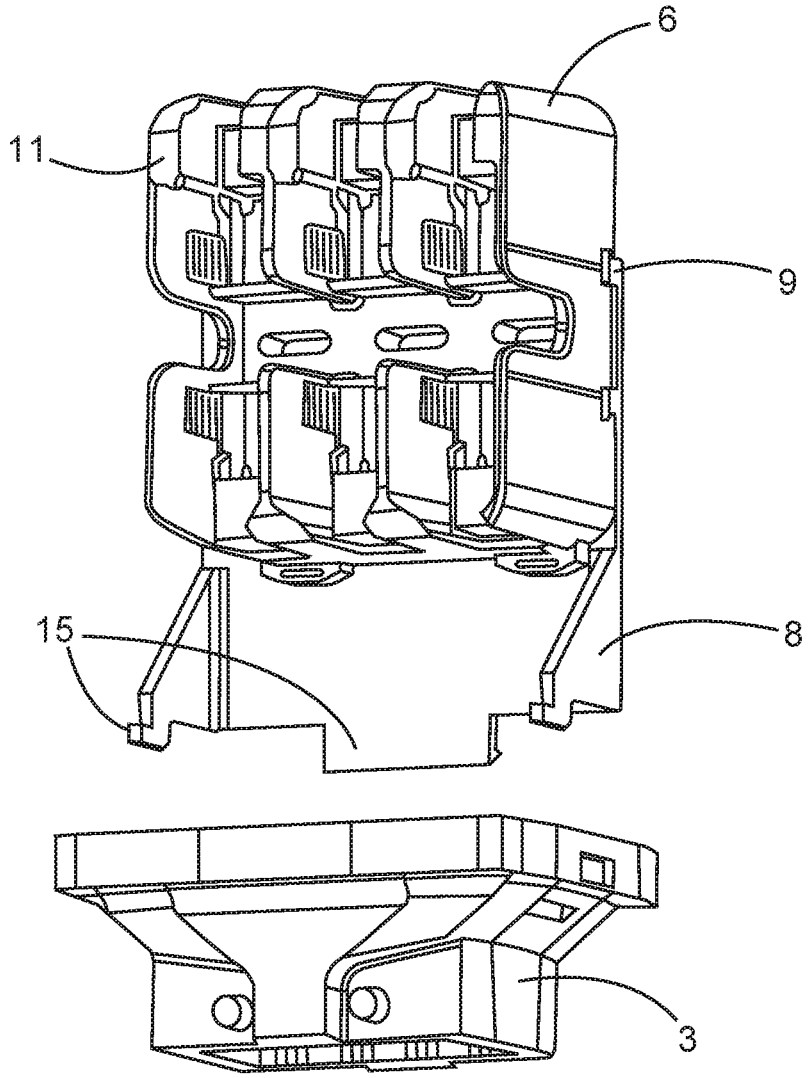

An exemplary embodiment of the invention is shown in the drawings and is explained in greater detail below. The drawings show:

FIG. 1 a depiction of an industrial electrical connector according to the invention;

FIG. 2 a perspective view of a partially disassembled industrial electrical connector according to the invention;

FIG. 3 a perspective view of a fuse holder having a lower housing portion and carrier element arranged thereon;

FIG. 4 a perspective view of a fuse holder and carrier element arranged thereon with a lower housing portion.

The figures contain partially simplified, schematic depictions. In part, like identical signs are used for like, but possibly not identical elements. Different views of like elements could be scaled differently. Directional indications such as "left", "right", "top" and "bottom" are to be understood with reference to the figure in question and may vary in the individual depictions with respect to the object depicted.

FIG. 1 shows an industrial electrical connector 1 according to the invention. The upper housing portion 2 is provided here with a cable fastening 12. The cable fastening 12 shown is a cable gland which, by screwing on the cap, clamps a cable that has been fed through and thus secures the cable against being pulled out. Furthermore, an inspection glass 13 can be seen, which protects a viewing opening 10 against the ingress of foreign bodies. Depending on the field of application of the industrial electrical connector 1, it may be expedient to arrange the inspection glass 13 in a waterproof and/or dustproof manner on the upper housing portion 2. The upper housing portion 2 is releasably connected to the lower housing portion 3. In the illustrated embodiment, a flat tool is required, for example a slotted screwdriver, to release a latching between the upper housing portion 2 and the lower housing portion 3. This embodiment is intended to prevent the industrial electrical connector 1 from being able to be opened easily, without the use of a tool.

FIG. 2 shows a partially disassembled view of an industrial electrical connector 1. More precisely, in the embodiment shown, the upper housing portion 2 has been released from the lower housing portion 3. This reveals the fuse holder 6 arranged on a carrier element 8. Furthermore, electrical fuses 7 inserted in the fuse holder 6 are visible. It is self-evident to a person skilled in the art that besides the fuse holder 6 shown, contact carriers 4 and 4' inserted in the lower housing portion 3 as well as contacts 5 located therein are also recognizable. The contacts 5' inserted in the contact carrier 4' are arranged within the insulating cylindrical extensions.

A clever feature of the industrial electrical connector 1 according to the invention becomes clear in FIG. 3. A connecting element 9 is integrally molded on the carrier element 8. A connecting element 9 embodied as a top-hat rail is shown, whereby a fuse holder 6 can be used as a known component from a switch cabinet. In another embodiment, a standardized top-hat rail can also be attached to the carrier element 8 as a connecting element, for example by means of a screw or rivet connection. In order to be able to lay electrical conductors cleanly past the fuse holder 6, a stop 14 is provided. This stop 14 simplifies the positioning of the fuse holder 6 on the carrier element 8, so that further conductors can be easily routed past the fuse holder. This embodiment can be particularly advantageous when a PE conductor is used. In this example, the lower housing portion 3 is releasably connected to the carrier element 8. However, a one-piece design is also conceivable. Lastly, an illuminant 11 arranged on the fuse holder 6 is also shown. In this case, the illuminant 11 is positioned in such a way that, in the assembled state of the industrial electrical connector 1, the illuminant 11 is identified through the viewing opening 10 and the inspection glass 13 of the upper housing portion 2.

The two-part design of the lower housing portion 3 and the carrier element 8 becomes clearer in FIG. 4. Also visible in this depiction are inserted latching elements 15. These latching elements 15 are engaged with the lower housing portion 3 so that the carrier element 8 and the fuse holder 6 attached thereto are easily connected to the lower housing portion 3.

Even though various aspects or features of the invention are each shown in combination in the figures, it is apparent to a person skilled in the art—unless otherwise indicated—that the combinations shown and discussed are not the only possible ones. In particular, corresponding units or feature complexes from different embodiments may be interchanged with each other.

Electrical Connector Having Fuse Holder

LIST OF REFERENCE SIGNS

1 industrial electrical connector
2 upper housing portion
3 lower housing portion
4, 4' contact carrier
5, 5' contact
6 fuse holder
7 electric fuse
8 carrier element
9, 9' connecting element
10 viewing opening
11 illuminant
12 cable attachment
13 inspection glass
14 stop
15 latching element

The invention claimed is:

1. An industrial electrical connector, composed of an upper housing portion for holding a cable and a lower housing portion for holding at least one contact carrier, which lower housing portion is configured to be releasably connected to the upper housing portion, wherein the contact carrier holds at least one contact configured for establishing a connection to a corresponding mating contact for transferring of at least electrical power and/or electrical signals/data, wherein at least one fuse holder configured for holding at least one electrical fuse is arranged within the industrial electrical connector; and the industrial electrical connector further comprises a carrier element and the fuse holder is releasably connected to the carrier element.

2. The industrial electrical connector as claimed in claim 1, wherein the fuse holder is connected to the lower housing portion or to the upper housing portion by a carrier element.

3. The industrial electrical connector as claimed in claim 1, wherein the carrier element is releasably connected to the upper housing portion or to the lower housing portion.

4. The industrial electrical connector as claimed in claim 1, wherein the carrier element and the fuse holder are connected to at least one corresponding connecting element.

5. The industrial electrical connector as claimed in claim 4, wherein the connecting element is configured to establish a form-fit connection between the fuse holder and the carrier element.

6. The industrial electrical connector as claimed in claim 1, wherein a state of the at least one inserted electrical fuse is represented by at least one signal.

7. The industrial electrical connector as claimed in claim 1, wherein a state of the at least one inserted electrical fuse can be read through a viewing opening in the upper housing portion and/or the lower housing portion.

8. The industrial electrical connector as claimed in claim 1, wherein a state of the at least one inserted electrical fuse is indicated by an illuminant.

9. The industrial electrical connector as claimed in claim 8, wherein the illuminant is embodied is a light-emitting diode.

10. An industrial electrical connector, composed of an upper housing portion for holding a cable and a lower housing portion for holding at least one contact carrier, which lower housing portion is configured to be releasably connected to the upper housing portion, wherein the contact carrier holds at least one contact configured for establishing a connection to a corresponding mating contact for transferring of at least electrical power and/or electrical signals/data, wherein at least one fuse holder configured for holding at least one electrical fuse is arranged within the industrial electrical connector; and the industrial electrical connector further comprises a carrier element is releasably connected to the upper housing portion or the lower housing portion.

11. The industrial electrical connector as claimed in claim 10, wherein the fuse holder is connected to the lower housing portion or to the upper housing portion by a carrier element.

12. The industrial electrical connector as claimed in claim 10, wherein the carrier element and the fuse holder are connected to at least one corresponding connecting element.

13. The industrial electrical connector as claimed in claim 10, wherein the connecting element is configured to establish a form-fit connection between the fuse holder and the carrier element.

14. The industrial electrical connector as claimed in claim 10, wherein a state of the at least one inserted electrical fuse is represented by at least one signal.

15. The industrial electrical connector as claimed in claim 10, wherein a state of the at least one inserted electrical fuse can be read through a viewing opening in the upper housing portion and/or the lower housing portion.

16. The industrial electrical connector as claimed in claim 10, wherein a state of the at least one inserted electrical fuse is indicated by an illuminant.

17. The industrial electrical connector as claimed in claim 10, wherein the illuminant is embodied as a light-emitting diode.

18. An industrial electrical connector, composed of an upper housing portion for holding a cable and a lower housing portion for holding at least one contact carrier, which lower housing portion is configured to be releasably connected to the upper housing portion, wherein the contact carrier holds at least one contact configured for establishing a connection to a corresponding mating contact for the transfer of at least electrical power and/or electrical signals/data, wherein at least one fuse holder configured for holding at least one electrical fuse is arranged within the industrial electrical connector, and the industrial electrical connector further comprises a carrier element and the carrier element and the fuse holder is connected to at least one connecting element.

19. The industrial electrical connector as claimed in claim 18, wherein the fuse holder is connected to the lower housing portion or to the upper housing portion by a carrier element.

* * * * *